US006808332B1

(12) United States Patent
Demuth et al.

(10) Patent No.: US 6,808,332 B1
(45) Date of Patent: Oct. 26, 2004

(54) FLUID SQUEEGEE

(75) Inventors: Kade Howard Demuth, Saskatchewan (CA); Sheldon Foss, Olds (CA)

(73) Assignee: Kadon Industries Ltd., Alberta (CA)

( * ) Notice: Subject to any disclaimer, the term of this patent is extended or adjusted under 35 U.S.C. 154(b) by 0 days.

(21) Appl. No.: 10/443,420

(22) Filed: May 22, 2003

(51) Int. Cl.[7] ..... B05C 11/00; A47L 13/26
(52) U.S. Cl. ..... 401/266; 401/261; 401/139
(58) Field of Search ..... 401/266, 137, 401/138, 139, 261, 263, 265, 289, 25, 26, 27; 15/245

(56) References Cited

U.S. PATENT DOCUMENTS

| | | | | |
|---|---|---|---|---|
| 556,722 A | | 3/1896 | Ford | |
| 1,218,040 A | * | 3/1917 | Armstrong | 15/145 |
| 1,572,913 A | | 2/1926 | Finnell | |
| 1,656,208 A | | 1/1928 | LeVora | |
| 1,783,506 A | | 12/1930 | Homiller | |
| 2,246,640 A | | 6/1941 | Shurhay | |
| 2,497,674 A | | 2/1950 | Kolchinsky | |
| 2,638,730 A | | 5/1953 | Davidson | |
| 2,692,163 A | | 10/1954 | Geel | |
| 2,746,072 A | | 5/1956 | Lumpkin | |
| 3,082,467 A | | 3/1963 | Wells | |
| 3,134,129 A | * | 5/1964 | Samuel | 401/138 |
| 4,095,746 A | | 6/1978 | Anderberg et al. | |
| 4,778,298 A | | 10/1988 | Shin et al. | |
| 5,007,753 A | * | 4/1991 | England, Jr. | 401/139 |
| 5,271,682 A | * | 12/1993 | Realdon | 401/37 |
| 5,364,198 A | | 11/1994 | Skenderi | |
| 5,386,612 A | | 2/1995 | Sham | |
| 6,250,831 B1 | | 6/2001 | Craven | |
| 6,419,415 B1 | * | 7/2002 | Vosbikian et al. | 401/289 |

FOREIGN PATENT DOCUMENTS

| | | |
|---|---|---|
| WO | WO 94/24920 | 11/1994 |

* cited by examiner

*Primary Examiner*—David J. Walczak
(74) *Attorney, Agent, or Firm*—Dinsmore & Shohl LLP

(57) ABSTRACT

A fluid squeegee head for a fluid squeegee is provided which includes a mounting plate having apertures defined therein for attaching a squeegee blade thereto. The mounting plate further includes nozzles extending therethrough. Hollow brace members and a hollow shaft socket are positioned on the intake side of the mounting plate. The hollow shaft socket includes discharge ports that are aligned with the hollow brace members which extend away radially. The hollow brace members enclose the nozzles so as to create a sealed fluid passageway between the hollow shaft socket and the nozzles. The fluid squeegee further includes a hollow shaft and hollow handle which are connected between a hose and the sgueegee head such that fluids can be discharged onto a surface to be cleaned via the nozzles.

17 Claims, 8 Drawing Sheets

FLUID SQUEEGEE

FIELD OF THE INVENTION

The present invention generally relates to floor cleaning devices. More specifically, the present invention relates to a fluid squeegee.

BACKGROUND OF THE INVENTION

Floor cleaning devices adapted for attachment to a fluid hose are well known in the prior art. For example, U.S. Pat. No. 2,248,640 Issued to Shurhay and U.S. Pat. No. 4.09,.748 issued to Anderberg at al. both describe a water sweeping device including a pair of tubular members attached by a "T" fitting. These tubular members form a handle member and a cross member respectively, the latter having spray nozzles mounted therein. During operation, fluid flows through the hollow handle into the "T" fitting where it Is distributed to the cross member and, ultimately, ejected onto a cleaning surface.

There are two major drawbacks to the inventions described above. First, the sharp comerss of the "T" fitting are prone to fatigue cracks which result from oscillating forces applied during a cleaning operation. Second, the tubular cross members are prone to excessive bending.

A need therefore exists for an improved fluid squeegee.

SUMMARY OF THE INVENTION

It is an object of the present invention to provide a fluid squeegee which obviates or mitigates at least one of the disadvantages described above. In accordance with the present invention, there is provided a fluid squeegee head comprising a mounting plate defining a discharge face and an intake face; the mounting plate including mounting means for attaching a squeegee blade thereto; the mounting plate further including one or more discharge nozzles extending therethrough: a hollow shaft socket adjacent to, and extending away from, the intake face of the mounting plate; the hollow shaft socket adapted for attachment to a hollow fluid shaft; the hollow shaft socket having one or more discharge ports formed therein; and one or more hollow brace members; the hollow brace members corresponding In number to the number of discharge ports formed in the hollow shaft socket; the one or more hollow brace members being adjacent to and extending radially away from the one or more discharge ports and enclosing the discharge nozzles; and whereby the one or more hollow brace members form a sealed fluid passageway between the one or more discharge ports and one or more discharge nozzles.

According to another aspect of the invention a fluid squeegee head as set out above wherein said mounting plate includes a fluid squeegee head as claimed in claim 1 wherein said mounting plate includes a nozzle plate aperture into which a nozzle plate is inserted and attached, said nozzles extending through said nozzle plate.

The invention is also directed to a fluid squeegee comprising a fluid squeegee head as set out above further including a hollow fluid shaft having an intake end and a discharge end; whereby the intake end is adapted for sealing attachment to a hollow handle; whereby the discharge end is adapted for sealing attachment to the hollow shaft socket; and whereby the hollow shaft can accommodate fluid flow therethrough; a hollow handle adapted for sealing attachment to the intake end of the hollow shaft; the hollow handle being adapted for sealing attachment to a fluid hose; and the hollow handle including a valve mechanism for controlling fluid flow therethrough, and a squeegee blade attached to the mounting plate via a mounting means.

BRIEF DESCRIPTION OF THE DRAWINGS

These and other features of the invention will become more apparent from the following description in which reference is made to the appended drawings, in which.

DETAILED DESCRIPTION OF THE PREFERRED EMBODIMENT

Figure 1A:
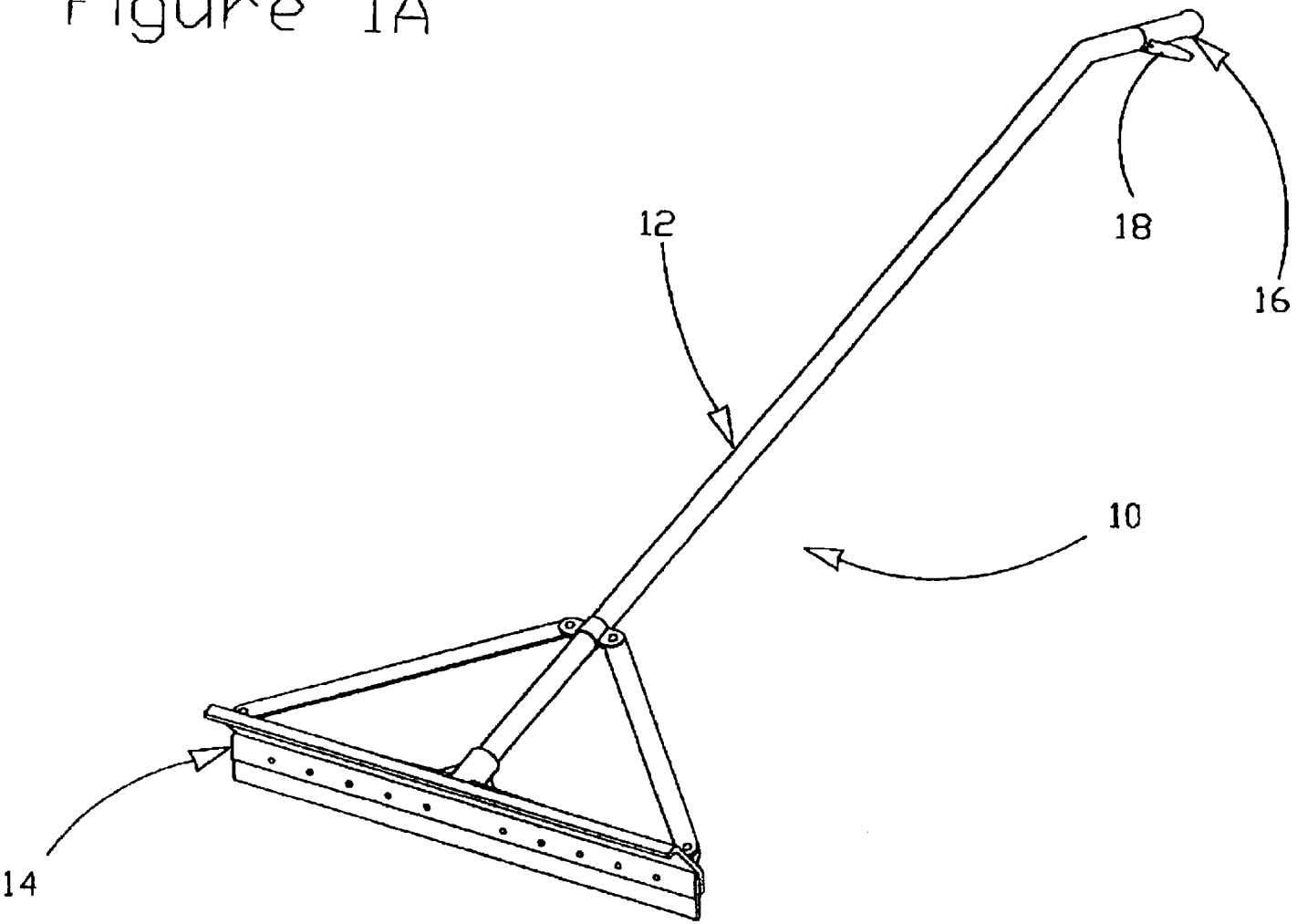
FIG. 1*a* presents an isometric view of a fluid squeegee in accordance with an embodiment of the present invention.

Having reference to FIG. 1*a* there is shown a fluid squeegee in accordance with an embodiment of the invention described above in the summary, depicted generally by reference number 10. Fluid squeegee 10 includes hollow fluid shaft 12 to which is attached squeegee head 14 at one end, and hollow handle 16 at the other. According to this embodiment of the invention, hollow handle 16 is adapted for sealing attachment to a fluid hose, such as a garden hose, via mechanical threads (not shown). Also included in handle 16 is valve 18 for controlling the flow of fluid through hollow handle 16, shaft 12, arid, ultimately, head 14.

Figure 1B:
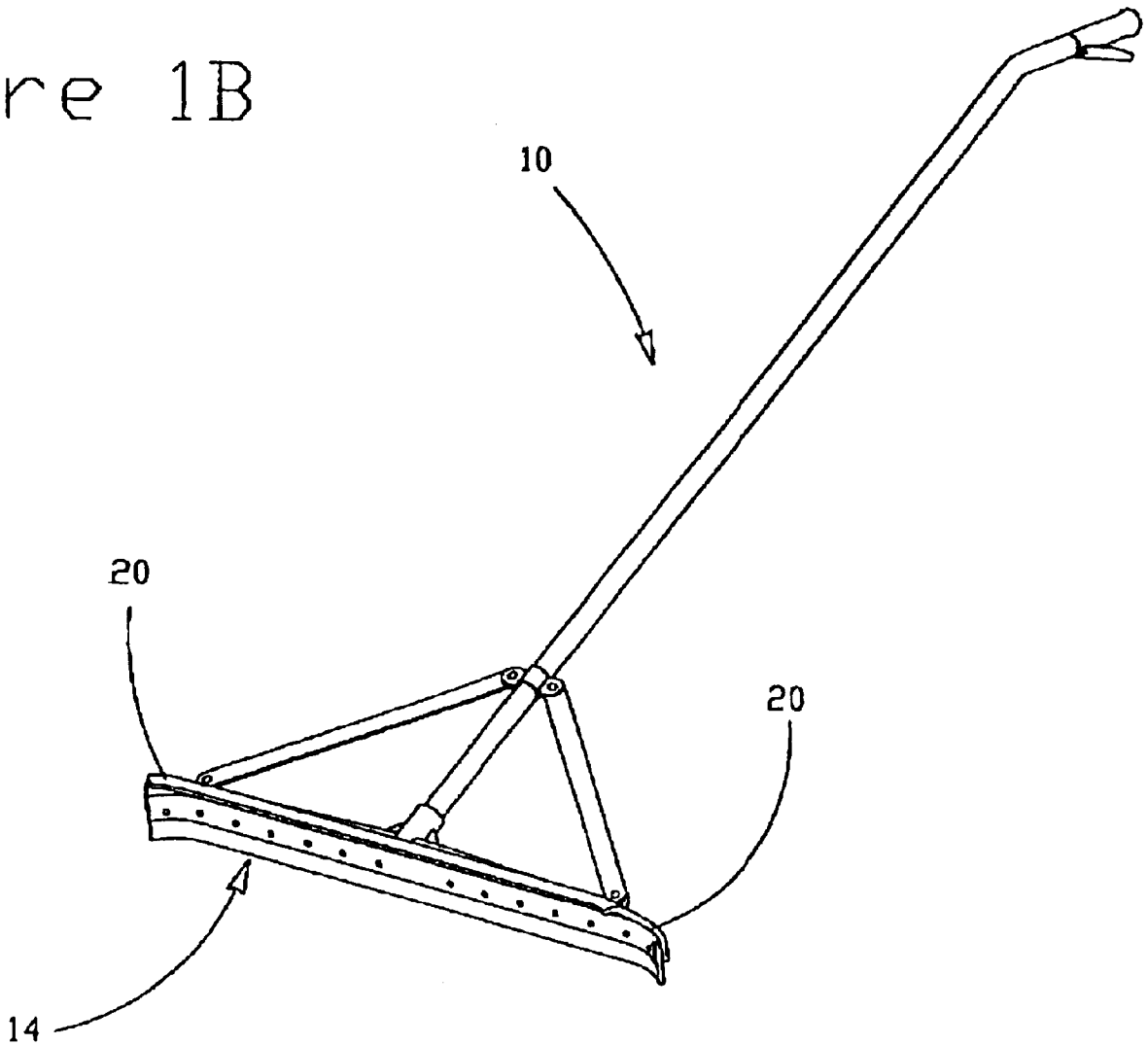
FIG. 1*b* Illustrates an isometric view of a fluid squeegee in accordance with another embodiment of the present invention.

FIG. 1*b* presents an alternative embodiment of the present invention wherein ends 20 of squeegee head 14 are curved inwardly towards the discharge face of head 14. This arrangement is designed to reduce fluid flow around ends 20 during operation of squeegee 10.

Figure 2A:
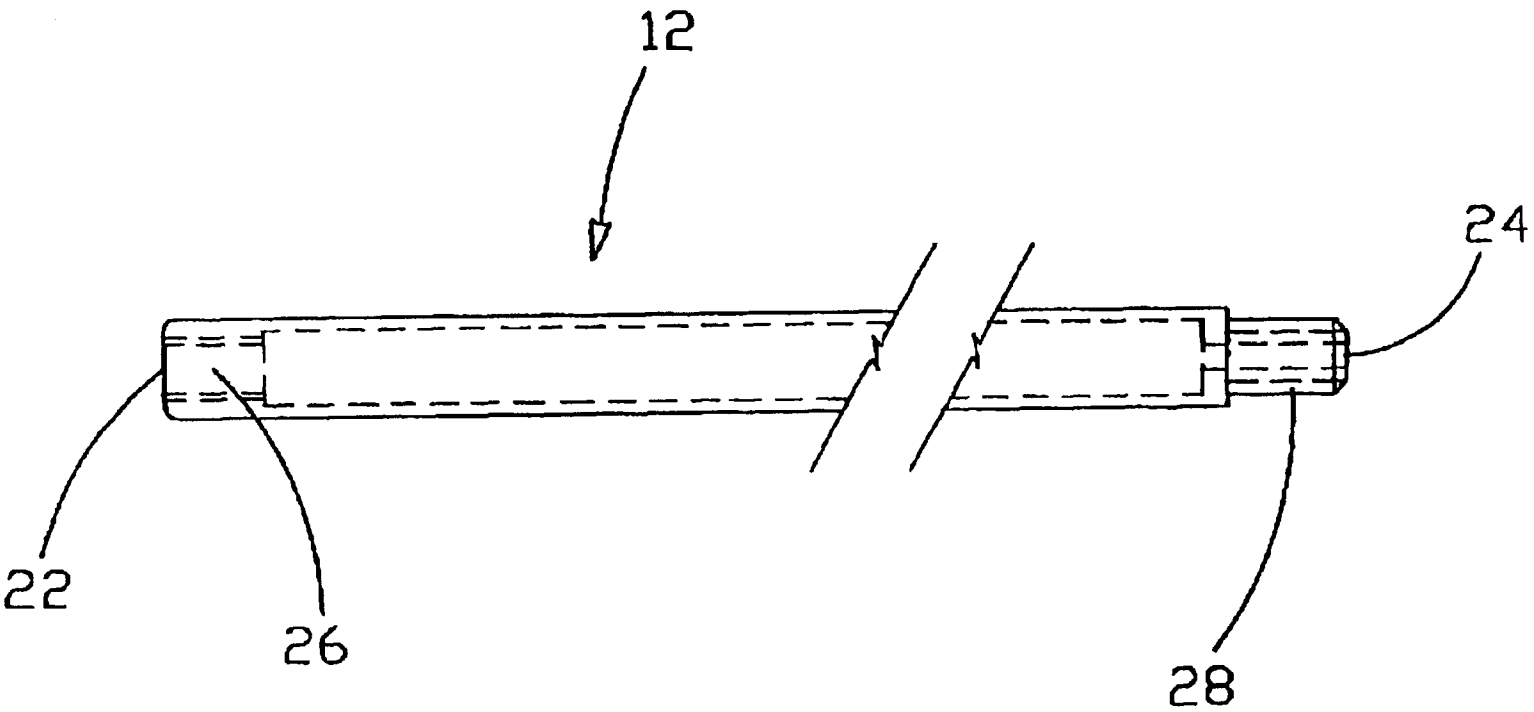
FIG. 2*a* presents a side elevation of a hollow shaft in accordance an embodiment of the present invention.
Figure 2C:
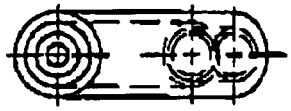
FIG. 2*c* presents a front elevation of a hollow shaft in accordance with another embodiment of the present invention.
Figure 2B:
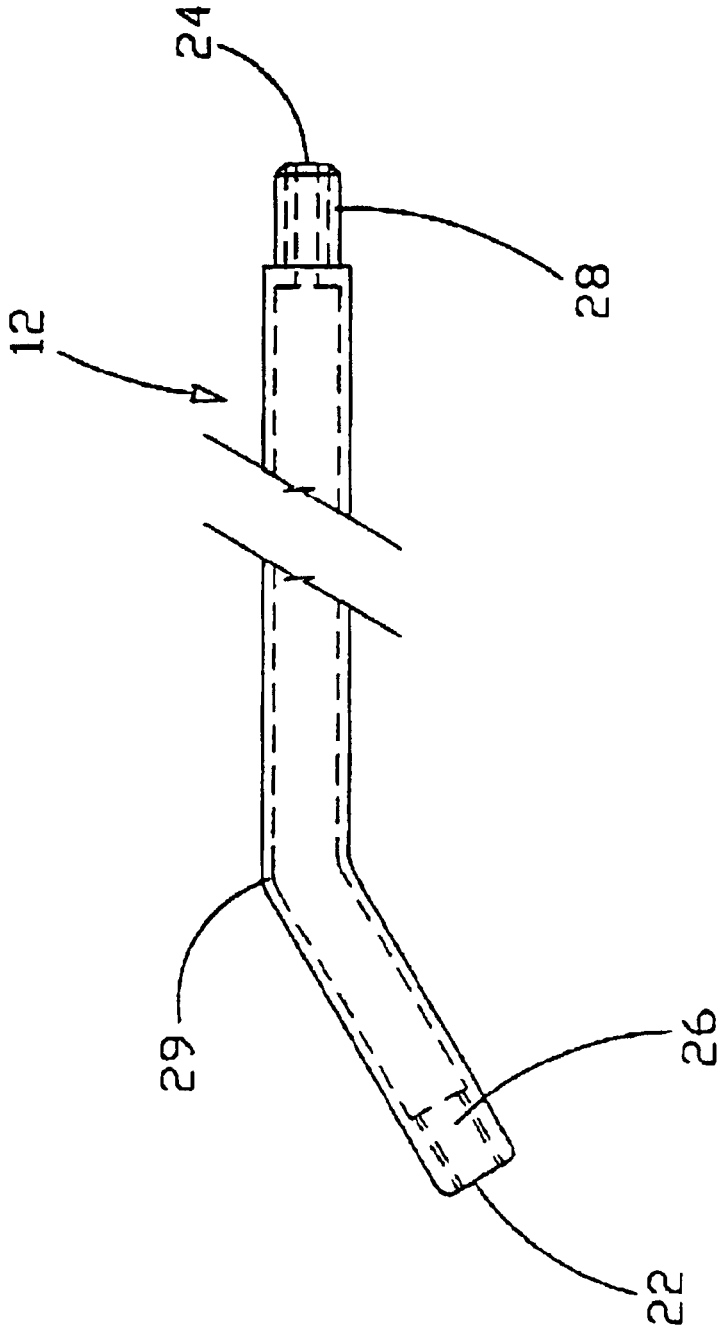
FIG. 2*b* presents a side elevation of a hollow shaft in accordance with another embodiment of the present invention.

A close-up side view of hollow fluid shaft 12 is shown in FIG. 2*a*. Hollow fluid shaft 12 includes an intake end 22 and a discharge end 24. Intake end 22 is adapted for sealing attachment to a fluid hose or alternatively, as in the preferred embodiment of the invention, hollow handle 16. To facilitate such attachment intake end 22 includes female receptacle 26, which, in the preferred embodiment of the invention, is designed to accept a standard ¾ hose thread. Similarly, discharge end 24 is adapted for sealing attachment to squeegee head 14. To facilitate this connection, the preferred embodiment of the invention includes male protrusion 28 into which are formed standard broom threads (not shown). As shown in FIGS. 2*b* and 2*c*, hollow fluid shaft 12 may also include angle 29 to minimize flex and improve operator comfort.

Although female and male attachment members are described for attaching shaft 12 to head 14 and handle 16 respectively, a person skilled in the art will appreciate that this arrangement could be inverted without affecting the operation of the invention described above in the summary. The only requirement is that the piece to which a respective end attaches must have the corresponding male or female member formed therein. A person skilled in the art will recognize, however, that mechanical threads are not essential and could, for example, be replaced by a snap fit arrangement or any other means known in the art.

Figure 3:
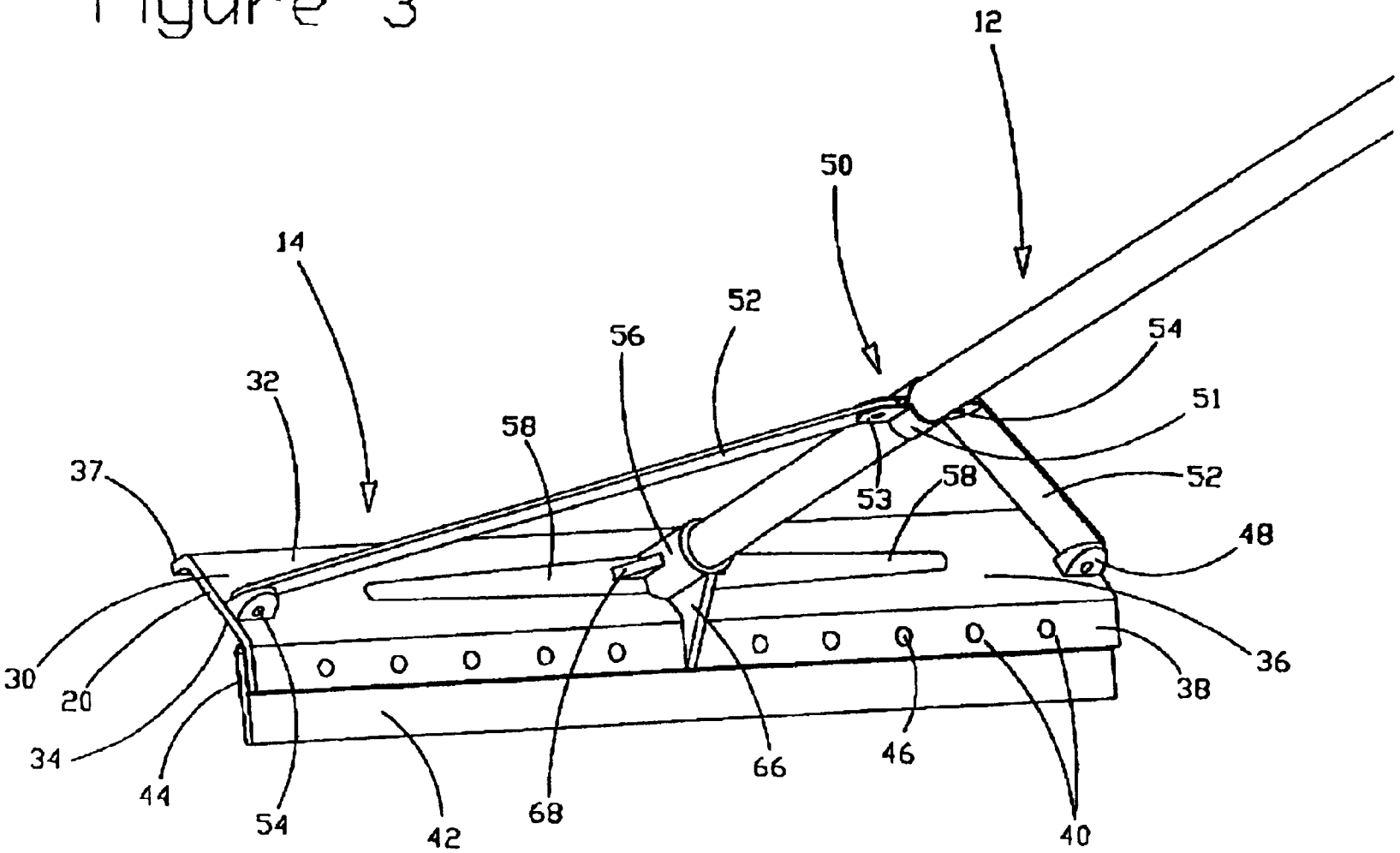
FIG. 3 presents an isometric view of a squeegee head in accordance with an embodiment of the present invention.

A detailed isometric view of squeegee head 14 is shown in FIG. 3 as having hollow fluid shaft 12 attached thereto. Squeegee head 14 includes mounting plate 30 which plate includes an intake face 32 and a discharge face 34. In accordance with this embodiment of the invention, mounting plate 30 is channel shaped thus defining web 36, upper flange 37 and lower flange 38. As will be apparent to one skilled in the art, flanges 37 and 38 restrict the bending of mounting plate 30 that would otherwise occur If plate 30 was merely flat. Extending through flange 38 are mounting apertures 40 into which fasteners 46 are inserted to mount squeegee blade 42, and blade mounting sleeve 44, thereto. As will be apparent to one skilled in the art, mounting apertures 40 are not essential to the invention described in the summary. For example, flange 38 could itself define a channel (not shown) into which blade 42 could be slid. Blade 42 could then be secured within said channel using any means known in the art, including, but not limited to, placing a fastener through both ends of flange 38.

To reduce bending stresses which occur between hollow fluid shaft 12 and squeegee head 14 support members 52 are mounted therebetween. To facilitate attachment of support members 52 to squeegee head 14, mounting eyelets 48 are positioned at ends 20 of intake face 32. Mounting eyelets 48 are adapted to receive fastener 54, which fastener is also adapted to pass through an aperture (not shown) in support member 52. The other end of support member 52 is similarly attached to attachment sleeve 50 via fastener 54. In accordance with this embodiment of the invention, sleeve 50 includes two semicircular members 51 having lateral mounting flanges 53 extending therefrom, the inside diameter of members 51 being slightly larger in size than the outside diameter of shaft 12.

As will be apparent to one skilled in the art, support members 52 provide greater structural support to shaft 12 thereby impeding the formation of fatigue cracks between shaft 12 and head 14.

To facilitate attachment of hollow fluid shaft 12 to squeegee head 14, hollow shaft socket 56 is situated adjacent to intake face 32 of squeegee head 14 and extends outwardly therefrom. In accordance with this embodiment of the invention, hollow shaft socket 66 includes mechanical threads (not shown) corresponding to those on male protrusion 24 of hollow fluid shaft 12.

Extending radially from hollow shaft socket 56 along intake face 32 are two hollow brace members 58. In accordance with this embodiment of the invention, brace members 58 are semi-conical in shape and taper in size as they extend away from socket 56.

Figure 4A:
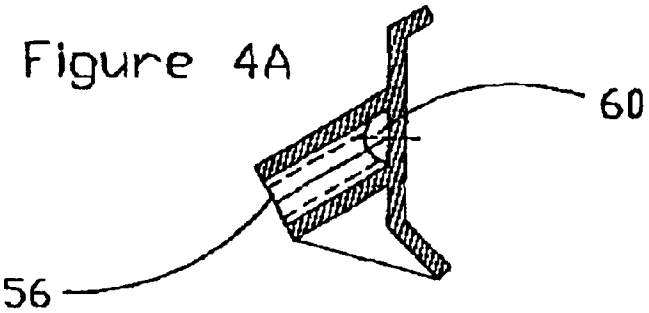
FIG. 4*a* presents a side section view of a squeegee head in accordance with an embodiment of the present invention as shown along section line A—A of FIG. 4*b;*
Figure 4B:
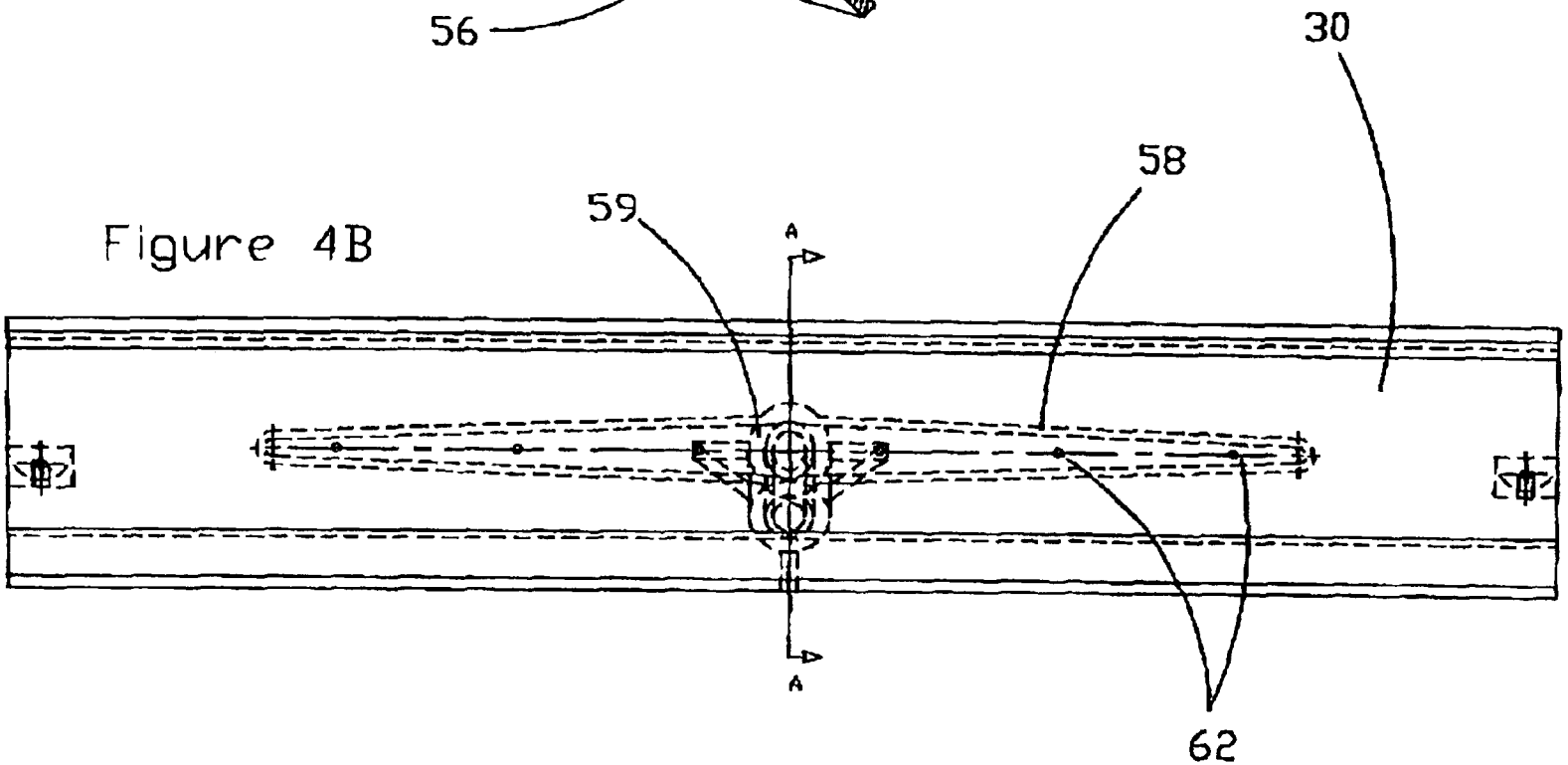
FIG. 4*b* presents a bottom view of a squeegee head in accordance with an embodiment of the present invention.

Referring to FIG. 4*a*, a side section of squeegee head 14 is shown along cutting line A—A of FIG. 4*b*. As shown therein, hollow shaft socket 56 has discharge port 60 formed in its side. In accordance with this embodiment of the invention, discharge port 60 is semi-circular in cross section having a radius corresponding to that of hollow brace members 68 at their intake ends 59. As will be apparent to one skilled in the art of fluid mechanics, smooth transitions between various parts of a fluid passageway are beneficial for minimizing fluid pressure loss.

As shown in FIG. 4*b*, hollow brace members 58 enclose discharge nozzles 62, which nozzles extend through mounting plate 30. Hollow brace members 58 therefore create a sealed fluid passageway between hollow discharge socket 56 and nozzles 62.

Figure 5:
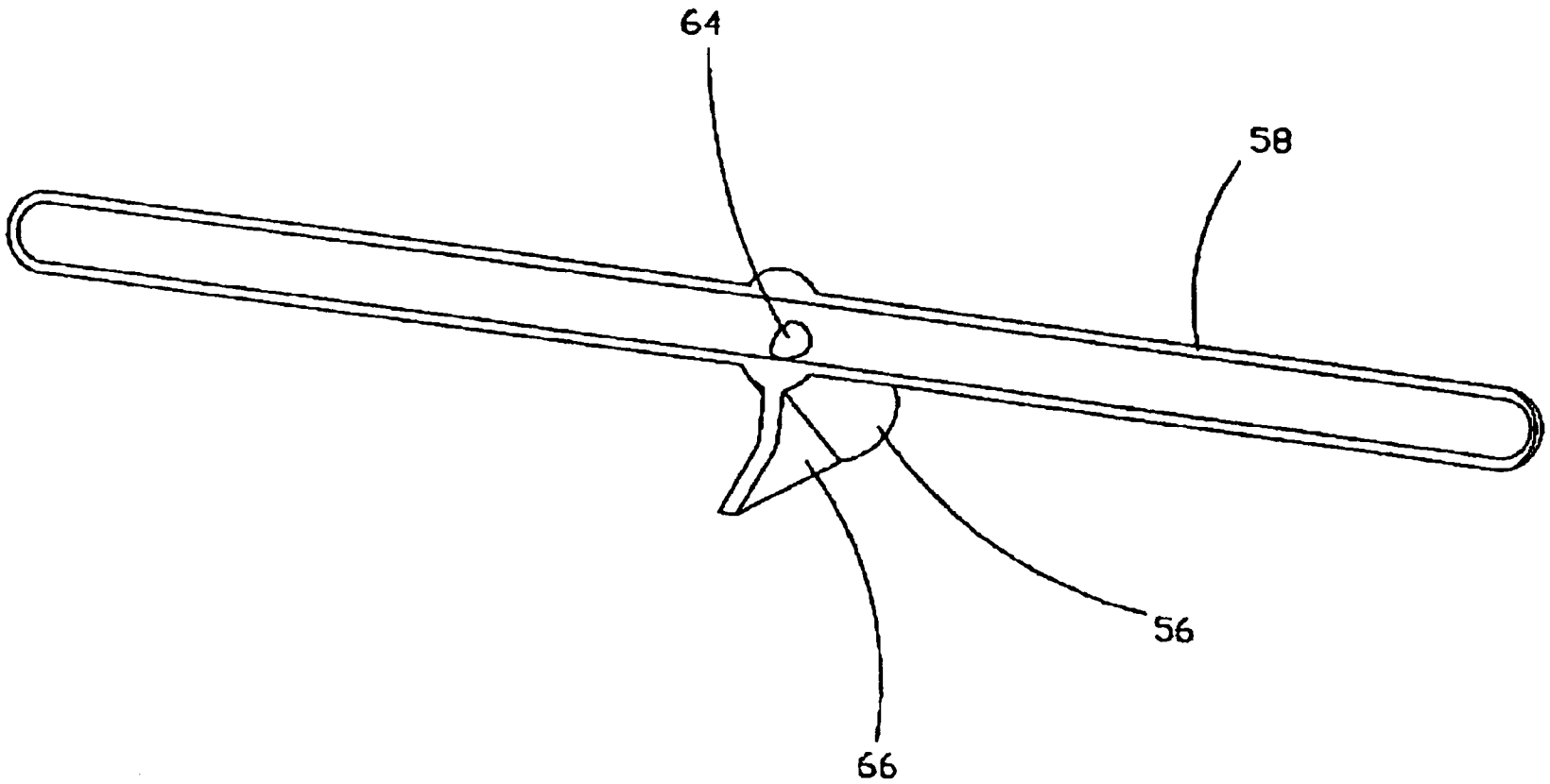
FIG. 5 presents an isometric view of hollow shaft socket and hollow brace member in accordance with an embodiment of the present invention.

In accordance with another embodiment of the invention, hollow shaft socket 56 and hollow brace members 58 form a single piece as shown in FIG. 5. As this piece is viewed from its hollow side, discharge opening 64 can be seen extending through hollow shaft socket 56. Also shown is support member 66 which member is adapted for attachment to intake face 32 of mounting plate 30 as shown in FIG. 3. Also shown in FIG. 3, is gusset 68, which also provides structural support to hollow shaft socket 56.

Figure 6:
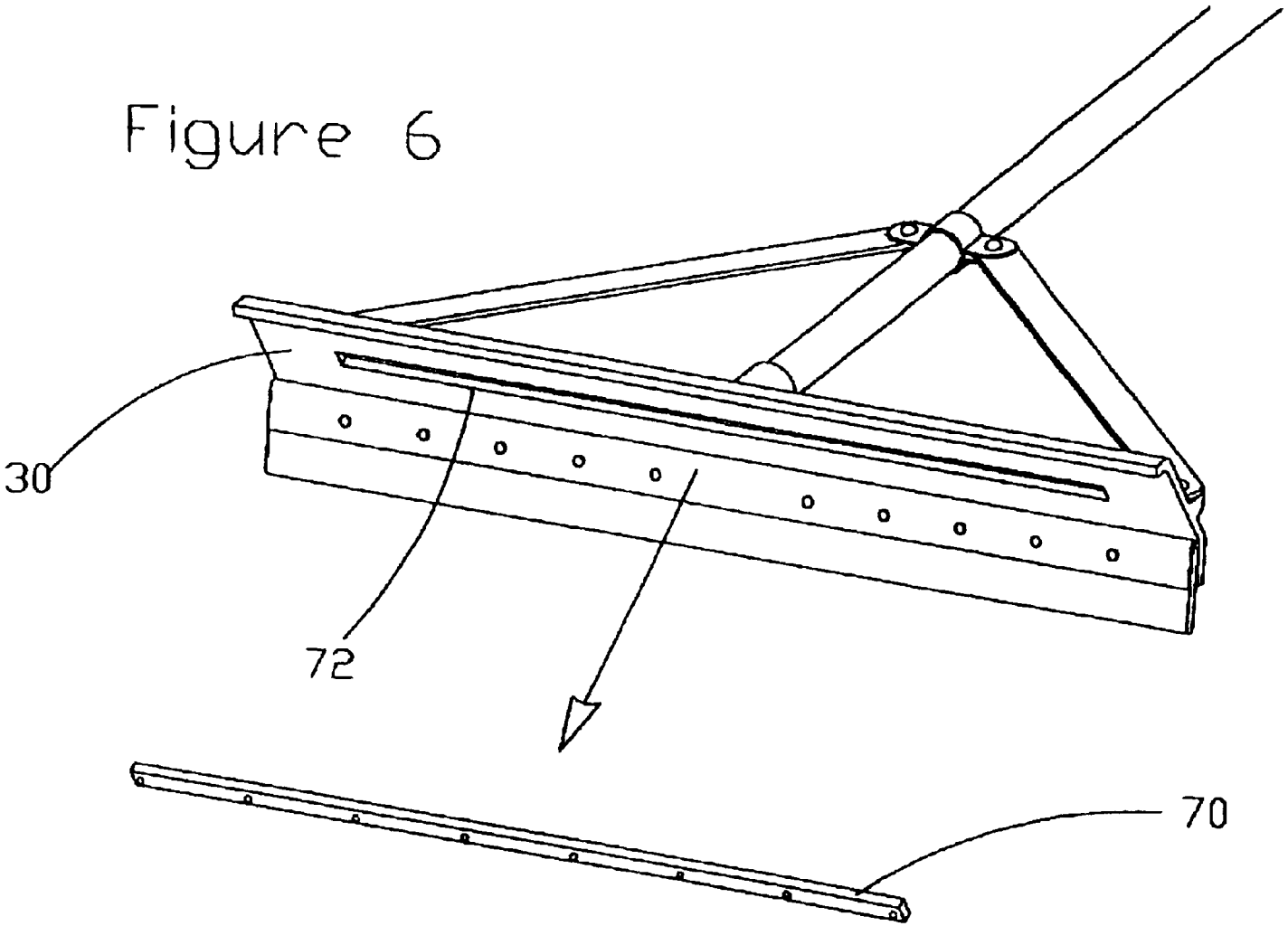
FIG. 6 presents an exploded isometric view of a mounting plate and nozzle plate in accordance with another embodiment of the present invention.

In an alternative embodiment of the invention as shown in FIG. 6, mounting plate 30 includes nozzle plate 70 which includes that portion of mounting plate 30 that is enclosed by hollow brace members 58 and hollow shaft socket 56. To mount nozzle plate 70 to mounting plate 30, a corresponding nozzle aperture 72 is formed in the latter. As will be apparent to one skilled in the art, a water tight seal between nozzle plate 70 and mounting plate 30 can be achieved through use of a gasket, silicone, or any other means known in the art.

By manufacturing nozzle plate 70 separately from mounting plate 30, detailed nozzle work can be performed, without having to use the entire mounting plate 30 as a workpiece. Furthermore, as will be apparent to one skilled in the art of plastic injection moulding, nozzle plate 70 enables hollow brace members 58, hollow shaft socket 56 and mounting plate 30 to be one piece thus minimizing the number of pieces to be attached. This is beneficial in that there is less assembly required and fewer attachments (e.g. welds) which tend to be structurally weak.

The way in which brace members are formed, however, is not essential to the invention described in the summary and could, for example, include forming a hollow semi-circular tube which is later sealed by end caps (not shown).

Having set out all of the structural components, the operation of fluid squeegee 10 will now be described. Upon attachment of a fluid hose to hollow handle 16, fluid can be introduced into squeegee 10 via valve 18. As fluid flows through hollow fluid shaft 12, it enters hollow shaft socket 56 where it is then distributed to hollow brace members 58. Fluid flowing through hollow brace members 58 is then ejected onto a cleaning surface via nozzles 62. By releasing valve member 18 fluid flow through squeegee 10 can be terminated. The squeegee operator can then whisk away the ejected fluids, utilizing squeegee blade 42.

The embodiments of the present invention described above are beneficial over the prior art in that greater structural integrity is achieved between squeegee head 14 and hollow fluid shaft 12.

Although the hollow brace members in the preferred embodiment of the invention are semi-conical in shape, one skilled in the art will appreciate that the shape of these members will not affect the invention described above in the summary. For example, similar structural support could be achieved using tubular or rectangular shaped members.

Similarly, the invention described above in the summary is not limited to two hollow brace members. In fact, as one skilled in the art will appreciate, the greater the number of hollow brace members employed, the greater the structural integrity achieved.

While particular embodiments of the present invention have been shown and described, it is clear that changes and modifications may be made to such embodiments without departing from the true scope and spirit of the invention. Thus, it is intended that the present invention cover the modifications and variations of this invention provided they come within the scope of the appended claims and their equivalents.

What is claimed is:

1. A fluid squeegee head comprising:

a mounting plate defining a discharge face and an intake face:

said mounting plate including a mounting portion for attaching a squeegee blade thereto; and said mounting plate further including a nozzle plate aperture into which a nozzle plate is inserted and attached, said nozzle plate having nozzles extending therethrough;

a hollow shaft socket adjacent to, and extending away from, said intake face of said mounting plate, said hollow shaft socket adapted for attachment to a hollow fluid shaft; and said hollow shaft socket having one or more discharge ports formed therein; and one or more hollow brace members;

said hollow brace members corresponding in number to the number of discharge ports formed in said hollow shaft socket; and said one or more hollow brace members being adjacent to and extending radially away from said one or more discharge ports and enclosing said discharge nozzles; and whereby said one or more hollow brace members form a sealed fluid passageway between said one or more discharge ports and said one or more discharge nozzles.

2. A fluid squeegee head comprising:

a mounting plate defining a discharge face and an intake face;

said mounting plate including a mounting portion for attaching a squeegee blade thereto; and one or more discharge nozzles located within said mounting plate and extending therethrough;

a hollow shaft socket adjacent to, and extending away from, said intake face of said mounting plate;

said hollow shaft socket adapted for attachment to a hollow fluid shaft; and said hollow shaft socket having one or more discharge ports formed therein; and one or more hollow brace members;

said hollow brace members corresponding in number to the number of discharge ports formed in said hollow shaft socket;

said one or more hollow brace members being adjacent to and extending radially away from said one or more discharge ports and enclosing said discharge nozzles; and said hollow brace members are semi-conical in shape with tapered ends furthest from said socket; and whereby said one or more hollow brace members form a sealed fluid passageway between said one or more discharge ports and said one or more discharge nozzles.

3. A fluid squeegee head as claimed in claim 2 wherein said mounting plate is angled so as to define a web portion and a flange portion;

wherein said mounting portion comprises said flange portion with a plurality of mounting apertures extending therethrough;

wherein said nozzles extend through said web portion; and wherein said socket and said hollow brace members are adjacent to said web portion.

4. A fluid squeegee head as claimed in claim 1 further including:

at least one mounting eyelet positioned on said intake face of said mounting plate;

an attachment sleeve for fitting over a hollow fluid shaft; and at least one support member attached between said mounting eyelet and said attachment sleeve.

5. A fluid squeegee head comprising:

a mounting plate defining a discharge face and an intake face;

said mounting plate being channel shaped thereby further defining a web portion, a lower flange portion and an upper flange portion;

said mounting plate further including a plurality of mounting apertures extending through said lower flange portion for attaching a squeegee blade thereto; and said mounting plate further including one or more discharge nozzles extending through said web portion;

at least one mounting eyelet positioned on said intake face of said mounting plate;

an attachment sleeve for fitting over a hollow shaft;

at least one support member attached between said mounting eyelet and said attachment sleeve;

a hollow shaft socket adjacent to, and extending away from, said intake face of said mounting plate;

said hollow shaft socket adapted for attachment to a hollow fluid shaft;

said hollow shaft socket having one or more discharge ports formed therein; and one or more hollow brace members;

said of hollow brace members corresponding in number to the number of discharge ports formed in said hollow shaft socket;

said one or more hollow brace members being adjacent to and extending radially away from said one or more discharge ports and enclosing said discharge nobles; and said hollow brace members being semi-conical in shape, with the tapered ends being furthest from said socket;

said hollow shaft socket and said hollow brace members are adjacent to said web portion; and whereby said one or more hollow brace members form a sealed fluid passageway between said one or more discharge ports and said one or more discharge nozzles.

6. A fluid squeegee comprising a fluid squeegee head as claimed in claim 5 further including:

a hollow fluid shaft having an intake end and a discharge end;

whereby said intake end is adapted for sealing attachment to a hollow handle;

whereby said discharge end is adapted for sealing attachment to said hollow shaft socket; and whereby said hollow fluid shaft can accommodate fluid flow therethrough;

a hollow handle adapted for sealing attachment to said intake end of said hollow fluid shaft;

said hollow handle being adapted for sealing attachment to a fluid hose; and said hollow handle including a valve mechanism for controlling fluid flow therethrough; and a squeegee blade attached to said mounting plate via said mounting apertures.

7. A fluid squeegee head as claimed in claim 5 wherein said mounting plate has ends, which ends are curved inwardly toward said discharge face.

8. A fluid squeegee comprising a fluid squeegee head as claimed in claim 7 further including:

a hollow fluid shaft having an intake end and a discharge end;

whereby said intake end is adapted for sealing attachment to a hollow handle;

whereby said discharge end is adapted for sealing attachment to said hollow shaft socket; and whereby said hollow fluid shaft can accommodate fluid flow therethrough;

a hollow handle adapted for sealing attachment to said intake end of said hollow fluid shaft;

said hollow handle being adapted for sealing attachment to a fluid hose; and said hollow handle including a valve mechanism for controlling fluid flow therethrough; and a squeegee blade attached to said mounting plate via said mounting apertures.

9. A fluid squeegee comprising a fluid squeegee head as claimed in claim 1 further including:

a hollow fluid shaft having an intake end and a discharge end;

whereby said intake end is adapted for sealing attachment to a hollow handle;

whereby said discharge end is adapted for sealing attachment to said hollow shaft socket; and whereby said hollow shaft can accommodate fluid flow therethrough;

a hollow handle adapted for sealing attachment to said intake end of said hollow shaft;

said hollow handle being adapted for sealing attachment to a fluid hose; and said hollow handle including a valve mechanism for controlling fluid flow therethrough; and a squeegee blade attached to said mounting plate via said mounting means.

10. A fluid squeegee as defined in claim 9 wherein said mounting plate includes a nozzle plate aperture into which a nozzle plate is inserted and attached, said nozzles extending through said nozzle plate.

11. A fluid squeegee as claimed in claim 9 wherein said hollow brace members are semi-conical in shape, and wherein the tapered ends of said semi-conical braces are furthest from said socket.

12. A fluid squeegee head comprising:

a mounting plate defining a discharge face and an intake face;

said mounting plate including a mounting portion for attaching a squeegee blade thereto; and said mounting plate further including a nozzle plate aperture into which a nozzle plate is inserted and attached, said nozzle plate having nozzles extending therethrough; and a hollow shaft socket adjacent to, and extending away from, said intake face of said mounting plate;

said hollow shaft socket adapted for attachment to a hollow fluid shaft; and said hollow shaft socket having two discharge ports formed therein: and two hollow brace members on said intake face of said mounting plate, one hollow brace member being adjacent to and extending radially away from each of said discharge ports and enclosing at least one discharge nozzle; and whereby the hollow brace members form sealed fluid passageways between the discharge ports and the discharge nozzles.

13. A fluid squeegee head as claimed in claim 12 wherein said hollow brace members are semi conical in shape with tapered ends furthest from said socket.

14. A fluid squeegee head comprising:

a mounting plate defining a discharge face and an intake face;

said mounting plate having ends curved inwardly toward said discharge face said mounting plate being channel shaped thereby defining a web portion, a lower flange portion and an tipper flange portion;

said lower flange portion being adapted for attaching a squeegee blade thereto; and one or more discharge nozzles located within said web portion of said mounting plate and extending therethrough;

a hollow shaft socket adjacent to and extending away from the web portion of said intake fare of said mounting plate;

said hollow shaft socket adapted for attachment to a hollow fluid shaft;

said hollow shaft socket having tow discharge ports formed therein: and two hollow brace members on said web portion of the mounting plate, one hollow brace member being adjacent to and extending radially away from each of said discharge ports and enclosing at least one discharge nozzle; and whereby said hollow brace members form sealed fluid passageways between said discharge ports and said discharge nozzles.

15. A fluid squeegee as defined in claim 14 wherein said mounting plate includes a nozzle plate aperture for receiving a nozzle plate, said nozzles being located in said nozzle plate.

16. A fluid squeegee head as claimed in claim 14 wherein said hollow brace members are semi-conical in shape with tapered ends furthest from said socket.

17. A fluid squeegee comprising a fluid squeegee head as claimed in claim 14 and further including:

a handle comprising:

a hollow fluid shaft having a discharge end adapted for sealing attachment to said hollow shaft socket and an intake end for sealing attachment to a source of fluid; and a valve mechanism in the hollow fluid shaft for controlling fluid flow therethrough; and a squeegee blade attached to said lower flange portion of said mounting plate.

* * * * *

UNITED STATES PATENT AND TRADEMARK OFFICE

CERTIFICATE OF CORRECTION

PATENT NO. : 6,808,332 B1
DATED : October 26, 2004
INVENTOR(S) : Demuth et al.

It is certified that error appears in the above-identified patent and that said Letters Patent is hereby corrected as shown below:

Column 6,
Line 53, “nobles;” should read -- nozzles; --

Column 8,
Line 8, “therein:” should read -- therein; --
Line 26, “tipper” should read -- upper --
Line 34, “fare” should read -- face --
Line 38, “tow” should read -- two --
Line 39, “therein:” should read -- therein; --

Signed and Sealed this

Seventeenth Day of May, 2005

JON W. DUDAS
*Director of the United States Patent and Trademark Office*